United States Patent [19]

Bernardis

[11] 4,408,907

[45] Oct. 11, 1983

[54] DOT PRINTING DEVICE FOR ACCOUNTING, TERMINAL, TELEWRITING MACHINE, AND SIMILAR OFFICE MACHINE

[75] Inventor: Francesco Bernardis, Ivrea, Italy

[73] Assignee: Ing. C. Olivetti & C., S.p.A., Ivrea, Italy

[21] Appl. No.: 199,189

[22] Filed: Oct. 21, 1980

[51] Int. Cl.[3] ..... B41J 3/12

[52] U.S. Cl. ..... 400/124; 101/93.05

[58] Field of Search ..... 101/93.04, 93.05; 400/121, 124, 126

[56] References Cited

U.S. PATENT DOCUMENTS

| | | | |
|---|---|---|---|
| 3,803,628 | 4/1974 | Van Brimer et al. | 400/126 X |
| 4,010,835 | 3/1977 | Martin et al. | 101/93.05 X |
| 4,190,845 | 2/1980 | Cooper et al. | 400/126 X |

FOREIGN PATENT DOCUMENTS

| | | | |
|---|---|---|---|
| 52-6418 | 1/1977 | Japan | 400/124 |

*Primary Examiner*—Paul T. Sewell

*Attorney, Agent, or Firm*—Edward F. McKie, Jr.

[57] ABSTRACT

A printing device comprising a printing head having 18 wires actuated by a corresponding number of control electro-magnets for writing on a recording support symbols and characters in conformity with dot matrices. The writing ends of the wires are aligned along a single line, the slanting of which relative to the direction of movement of the carriage is variable. With the writing ends vertically aligned the height of the 18 wires is equal to that of two lines of writing, as a result of which it is possible to print two rows of characters simultaneously. By inclining the head and suitably selecting the speed of movement it is possible to print a line at a time with high definition dot matrices.

5 Claims, 8 Drawing Figures

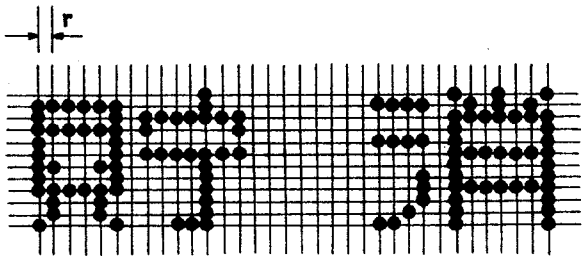
FIG. 6
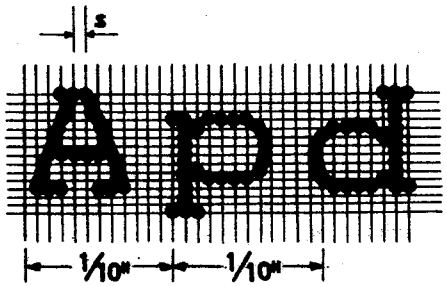
FIG. 7
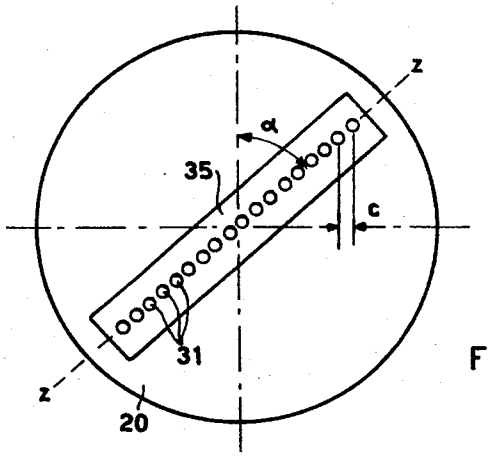
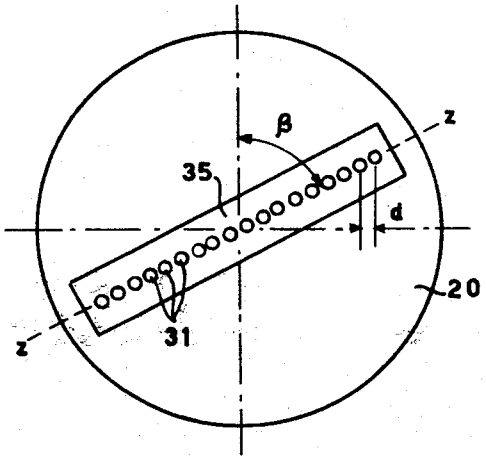

DOT PRINTING DEVICE FOR ACCOUNTING, TERMINAL, TELEWRITING MACHINE, AND SIMILAR OFFICE MACHINE

BACKGROUND OF THE INVENTION

The present invention relates to a dot printing device for accounting, terminal, telewriting machine, and similar office machine, comprising a plurality of writing wires having the writing ends subsantially aligned and selectively actuatable by a corresponding number of control electro-magnets to write symbols and characters on a recording support in conformity with dot matrices.

A dot printing device is known in which, to increase the writing speed, the writing ends of the wires are disposed side by side along two lines, parallel relative to each other and perpendicular to the direction of forward movement of the printing head. The wires are selectively actuated to write at high speed the characters of a line according to a dot matrix which is very readable but with rather low definition. The drawback of such a device is that the speed of the movement of the head-carrying carriage is very high, as a result of which the mechanical parts are subjected to considerable wear, and as a consequence of this the control circuit is necessarily complex and therefore costly.

A dot printing device is also known in which, to improve writing quality, several wires are used, the writing ends of which are aligned on a single line, slanting relative to the printing direction. In this manner the characters are written with matrices with high dot definition, with partial superimposition of the dots printed in their vertical lines. This printing device, however, suffers from the drawback of being rather slow, and thus little suited to being used in those machines such as terminals, where a high writing speed is required.

SUMMARY OF THE INVENTION

A first object of the present invention is that of providing a printing device able to write symbols and characters both at high speed, according to low definition dot matrices, and at low speed according to high definition dot matrices.

A second object of the present invention is that of providing a device which, though writing at high speed, is very reliable and inexpensive.

In accordance with those objects, and obviating the drawbacks of the known devices, the printing device according to the invention is characterised in that the inclination of the writing ends of the wires relative to the writing direction is selectively variable from a first position in which the wires can write simultaneously at least two lines of writing, to a plurality of other positions in which the wires can write on one line only symbols and characters with variable definition dot matrices.

This and other features of the invention will become clear from the following description of a preferred embodiment, given for the sake of example, but in no way limitatively, with the aid of the attached drawing.

BRIEF DESCRIPTION OF THE DRAWING

FIG. 6 is an exemplifying representation of other characters written by the device according to the invention in a second operating condition;

FIG. 7 is a further exemplifying repesentation of some printing characters written by the device according to the invention in a third operating condition;

DESCRIPTION OF PREFERRED EMBODIMENT

Figure 1:
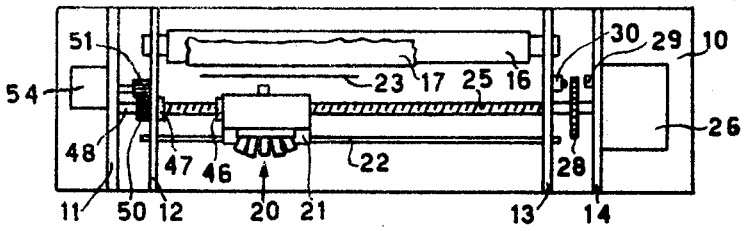
FIG. 1 is a plan view of a printing device according to the invention.

The printing device according to the invention comprises a base 10 (FIG. 1) provided with four vertical sides 11, 12, 13 and 14 parallel one with the others. Between the sides 12 and 13 a platen 16 is mounted; this bar holds a recording support 17 which, for example, may consist in a sheet of paper, a continuous form, a cheque, a small book or a bank card.

A printing head 20 with wires, which will be described in detail hereinbelow, is mounted on a carriage 21 which is slidable along a front guide 22, fixed to the sides 12 and 13 and parallel with the bar 16.

An inked ribbon 23 is arranged in between the head 20 and the bar 16.

For movement in front of bar 16, carriage 21 is in engagement with a screw 25, rotatably mounted on the sides 12 and 13 and joined directly to an electric motor 26, for example of step-by-step type, which controls its rotation.

A synchronisation disc 28 is keyed on the screw 25. Said disc 28 is provided with a series of radial notches, angularly equidistant one from the other, A photo-transistor 29 is disposed facing the notches and cooperates with a corresponding light transmitter 30. In particular, the photo-transistor 29 generates a synchronisation pulse FP at each elementary displacement p of the head 20 along the direction of movement of the carriage 21, which we shall also call the direction of writing. In the example described here the displacement p is 0.0529 mm, and has been selected according to criteria which will be described below.

The printing head 20 comprises a frame 33, on the front part of which eighteen control electromagnets 32 are mounted, which are individually joined to an equal number of writing wires 31.

Figure 4:
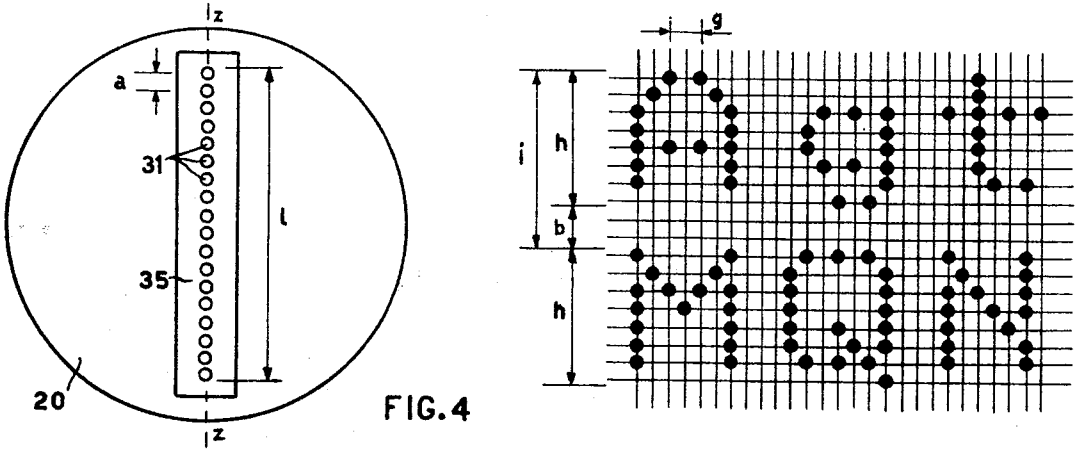
FIG. 4 is a first exemplifying representation of some printing characters written by the device according to the invention in a first operating condition.

The wires 31 have a diameter of 0.3 mm and are guided at their front end by a guide 35 which holds them aligned on a single line Z—Z (FIG. 4). The distance between the axes of the wires 31 is 0.423 mm and the total height 1 of the wires 31 is 7.491 mm. Such a height 1 is equal to twice the height h of a line of characters of standard type, plus the space b between two lines. These values have been chosen so as to supply a gap between lines of 4.23 mm, which is a standard spacing widely used among printers.

Figure 2:
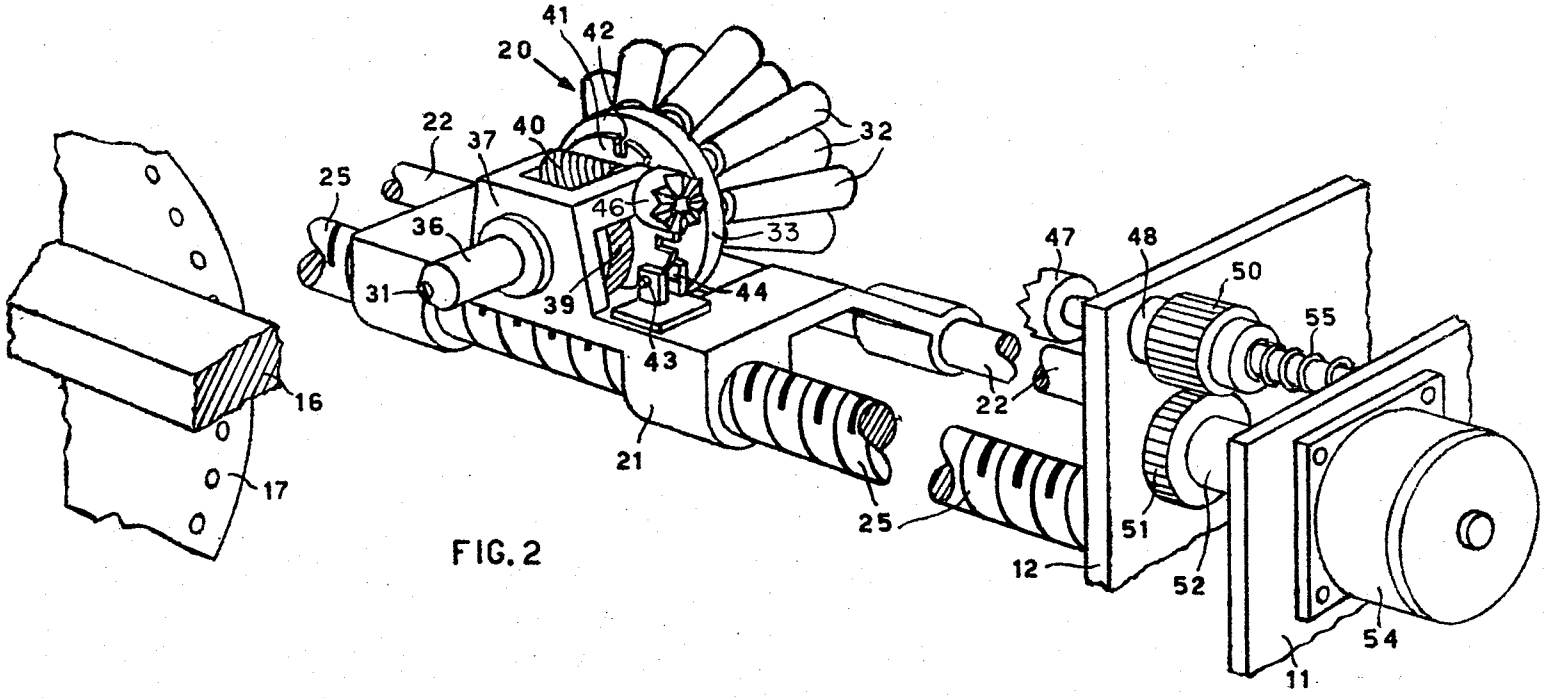
FIG. 2 is a rear left perspective of an enlarged detail of the device of FIG. 1.

The head 20 (FIG. 2) is mounted on the carriage 21 in such a manner as to be variably oriented relative to the direction of writing. For the purpose the front part 36 of the head 20 is rotatable on a support 37 of the carriage 21. A toothed wheel 39 is fixed to the head 20 and engages with a screw 40, rotatably mounted on the support 37. A disc 41, solid with the head 20, is provided with a series of radial notches 42 facing which, on the carriage 21, a photo-transistor 44 is arranged, cooperating with a corresponding light transmitter 43 to generate a synchronisation pulse FT (FIG. 3) when the head 20 is oriented according to one of the predetermined angles.

Coaxially with the screw 40 (FIG. 2) an engagement member 46 with front teeth is disposed, which, when the carriage 21 is at rest, can be coupled with a corresponding engagement member 47 which also has front teeth, and which is mounted on a shaft 48 rotatable between the sides 11 and 12 of the base 10.

On the shaft 48, between the sides 11 and 12, a toothed wheel 50, is keyed. Said wheel engages with a toothed wheel 51 mounted on a shaft 52, directly connected with an electric motor 54, of step-by-step type, which controls its rotation.

Shaft 48 is axially slidable, and a helical spring 55 holds the toothed wheel 50 constantly pushed against the side 12.

Figure 3:
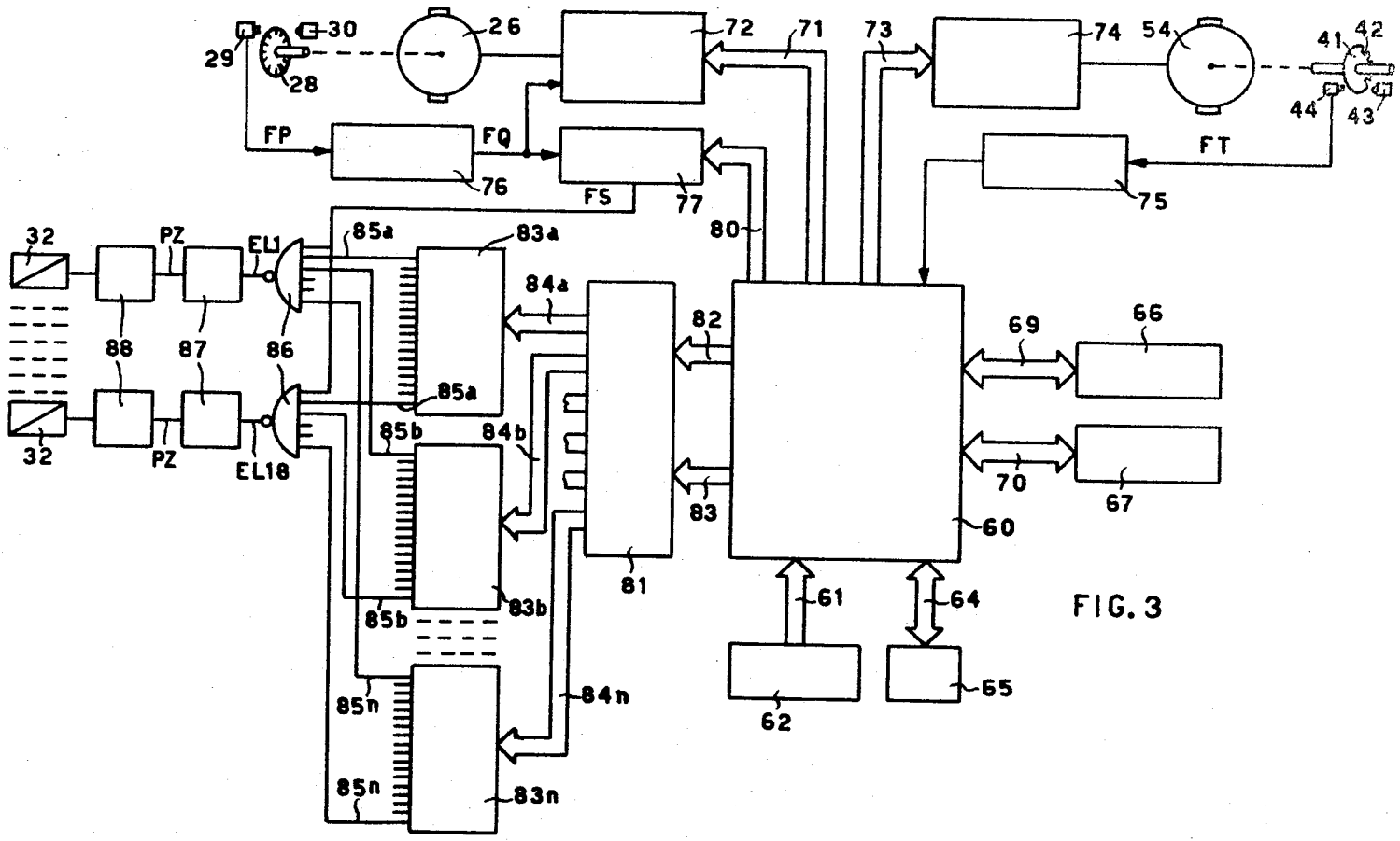
FIG. 3 is a diagram of the overall circuit for controlling the printing device according to the invention.

The electro-magnets 32 are of known type, for example of the type described in Italian Pat. No. 1011721 of the Applicant, and have an actuation cycle T of about 1000 μsec. The general circuit to control the excitation of the actuation electromagnets 32 and the electric motors 26 and 52 is illustrated in FIG. 3 and comprises, for example, a central unit 60 at which, along a first channel 61, the data of the alphanumerical characters and of the symbols to be printed arrive from an input device 62. Along a second channel 64, from an operational cabinet 65, the data relating to the type of writing to be effected arrive at the central unit. The central unit 60 is connected to two casual access memories RAM 66 and 67, by means of two channels 69 and 70 respectively.

The central unit 60 is also connected, through a channel 71 to a circuit 72 which controls the motor 26 and, through a channel 73, to a circuit 74 which controls the motor 54. The control circuits 72 and 74 are of known type, for example of the type described in Italian Pat. No. 1,009,488 of the Applicant.

The signal FT generated by the photo-transistor 44 is despatched to the central unit 60, after having been squared by a monostable circuit 75. The signal FP issuing from the photo-transistor 29 is despatched to a squaring circuit 76 which generates a corresponding square signal FQ, which is despatched to a binary counter 77 which generates a print enabling signal FS. The signal FQ is also despatched, as a retro-action signal, to the control circuit 72 of the motor 26. The binary counter 77 is joined to the central unit 60 by means of a channel 80 and can be set on a variable number, in such a manner that the time interval between two successive pulses of the signal FS may be suitably selected, as will be described hereinbelow.

The central unit 60 is joined to a multiple switching circuit 81 through two channels 82 and 83. In its turn, the circuit 81 is joined to a plurality of decoding ROM's 83*a*, 83*b*, . . . 83*n*, by means of a corresponding plurality of channels 84*a*, 84*b*, . . . 84*n*. Each ROM 83*a*, 83*b*, . . . 83*n* has 18 output wires 85*a*, 85*b*, . . . 85*n* respectively, connected to 18 NAND gates 86 which generate control signals EL 1÷EL 18, and each have an input connected to the output of the binary counter 77. Each control signal EL 1÷EL 18 issuing from the gates 86 is despatched to a corresponding monovibrator 87 which, in response, generates a pulse PZ which remains at the logical level 1 for the time actually necessary for controlling the electro-magnets 32 (approximately 500 μsec); this pulse PZ is then despatched, through a power circuit 88, to the corresponding electro-magnet 32.

The operation of the printing device so far described is as follows:

At rest, carriage 21 (FIG. 1) and the head 20 are stopped facing the left side 12, and the engagement member 46 and 47 are coupled together. In this position the motor 54, through the toothed wheels 50 and 51, the engagement 46, 47, the screw 40 and the toothed wheel 39, can rotate the head 20 relative to the support 37 of the carriage 21, disposing it in one of its possible patterns, suitably inclining the writing ends of the wires 31 relative to the horizontal direction of movement of the carriage 21. In the particular embodiment here described, three different angle settings of the head 20 relative to the horizontal direction have been hypothetically represented for the sake of example. In a first operating condition (FIGS. 4 and 5) the head 20 is positioned in such a manner that the line Z—Z of alignment of the writing ends of the wires 31 is vertical.

With the head 20 thus disposed the printing device according to the invention may write either simultaneously two lines of characters of standard height h according to a matrix of 7×7 dots (FIG. 4), or a single line of characters of double height 1 according to a matrix of 18×12 dots (FIG. 5), thus effecting, for example, letter heads and titles. In addition, again with the head 20 thus disposed, it is possible to write alphanumerical characters, graphic symbols, non-Latin characters and ideograms, according to dot matrices with variable definition. The definition and sizes of characters in the vertical direction are determined by the number of wires 31 chosen, while the corresponding values, in the horizontal direction, are determined by the pitch between two dots, with a consequent correction of the speed of movement of the carriage 21.

The speed of movement of the carriage 21 is indeed a determining factor to obtain a predetermined type of writing, account being taken of the time T taken by each electro-magnet 32 to effect a complete printing cycle.

For a type of writing such as that illustrated in FIG. 4, the distance g between two successive dots in the horizontal direction of writing is equal to ten elementary pitches p and is 0.529 mm; this space g is gone through by the carriage 21 in time T which is 1000 μsec. Therefore, for this type of writing, the speed of travel of the carriage 21 is 529 mm/sec., the head 20 can write 200 characters per second, for each line, and thus have a productivity of 400 characters per second. For this type of printing, in addition, the cabinet 65 is disposed in such a manner that the data transmitted by the input device 62 (FIG. 3) to the central unit 60 are first memorised on alternate lines of the two RAM memories 66 and 67, and then despatched in parallel, two lines at a time, to the circuit 81 through the channel 82. The central unit 60, through channel 83, conditions the circuit 81 so that the data from channel 82 go to the ROM 83*a*, through channel 84*a*, ruling out the other ROM's 83*b*, . . . 83*n*. The central unit 60, in addition, through channel 80, sets the binary counter 77 in such a manner that every five pulses FQ a pulse FS is generated, enabling printing. Finally, through channel 71, the central unit 60 controls the circuit 72 controlling the motor 26 in such a manner that the speed of travel of the carriage 21 be as predetermined.

Figure 5:
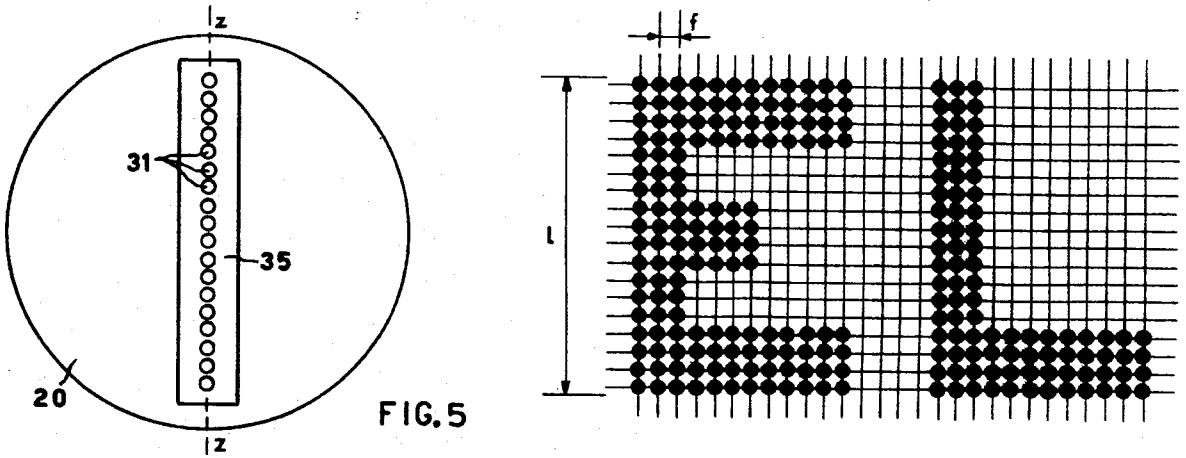
FIG. 5 is a second exemplifying representation of some printing characters written by the device according to the invention in the first operating condition.

For a type of writing such as that illustrated in FIG. 5 the distance f between two successive dots in the horizontal direction of writing is equal to six elementary pitches p, and is 0.3174 mm. As the carriage 21 has to travel through that space f in time T, which is 1000 μsec, the speed of travel of the carriage 21 in front of the bar 16 is 317.4 mm per second. In this case, in addition, the cabinet 65 is set in such a manner that the data transmitted from by the input device 62 (FIG. 3) to the central unit are memorised line by line on one of the RAM memories 66 or 67 and are then despatched serially to circuit 81, through the channel 82. The central unit 60, through channel 83, conditions the circuit 81 in such a manner that the data from channel 82 go to the ROM 83*b*, through the channel 84*b*, ruling out the other ROM's 83*a*, . . . , 83*n*. The central unit 60, in addition, through channel 80, sets the binary counter 77 in such a manner that every six pulses FQ a pulse FS is generated, enabling printing. Finally, through channel 71, the central unit 60 conditions the circuit 72 controlling the motor 26 in such a manner that the speed of travel of the carriage 21 be as predetermined.

Let us now assume that we wish to slant the head 20 to write characters and symbols according to other dot matrices.

When the head 20 (FIG. 1) is in the rest position, with the engagement members 46 and 47 coupled together, the cabinet 65 (FIG. 3) is set according to the type of character, symbol or ideogram to be printed. The central unit 60, through the channel 73, controls the circuit 74 controlling the motor 54, in such a manner than the head 20 (FIG. 2) rotates, relative to the support 37 of the carriage 21 by an angle α (FIG. 6) predetermined relative to the vertical axis. When the rotation has taken place, the photo-transistor 44 generates a retro-action pulse FT which is despatched to the central unit 60 to stop the motor 54 and the head 20. For the writing of characters of the Kanji alphabet according to a matrix of 12×14 dots, as illustrated in FIG. 6, the angle α is 48°37′. This angle α has been selected in such a manner that the projection c onto the horizontal axis of the distance between the centres of two wires 31 which are adjacent is an entire multiple of the elementary pitch p. In particular when α=48°37′ the distance c is equal to 6 p and is 0.3174 mm. This is in order to be able to obtain perfectly vertical signs.

In this second working condition and for this type of printing, the distance r between two successive dots in the horizontal direction of writing is equal to 5 elementary pitches p, and is 0.2645 mm. As the carriage 21 has to travel through this space r during the time T which is 1000 μsec, the speed of travel of the carriage 21 is 264.5 mm/sec. At this speed the head 20 can write 35 Kanji characters per second. In this case also the data transmitted to the central unit 60 are memorised line by line on one of the RAM memories 66 or 67, and are then despatched serially, through channel 82, to circuit 81 which despatches them to another of the n ROM's 83, non represented to simplify the drawings. In this case also, the central unit 60, through channel 80, sets the binary counter 77 in such a manner that every five FQ pulses a FS pulse, enabling printing, is generated.

If it is desired to write alpha-numerical characters and symbols according to a matrix with higher dot definition, the head 20 is inclined to a greater extent relative to the vertical axis, changing its setting, and bringing it to a third operating condition.

Setting the cabinet 65 (FIG. 3) on the new type of characters to be printed, when the head 20 is at rest, the central unit 60, through the channel 73, controls the circuit 74 controlling the motor 54 in such a manner that the head 20 (FIG. 2) rotates relative to the support 37 of the carriage 21 until it forms an angle β (FIG. 7), decided on beforehand, relative to the vertical axis. When rotation has taken place, the phototransistor 44 generates a retro-action pulse FT which stops the motor 54 and therefore the head 20.

Figure 8:
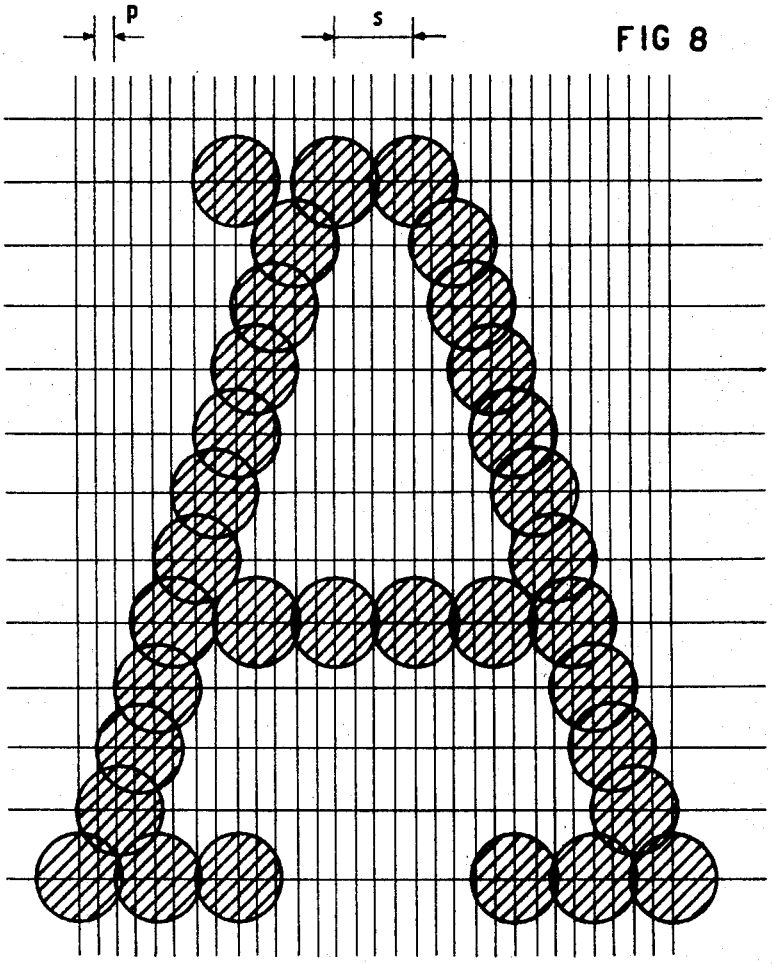
FIG. 8 is an enlarged detail of a printing character written by the device according to the invention in the third operating condition.

For high definition writing, according to a matrix of 15×48 dots, as illustrated in FIGS. 7 and 8, the angle β is 61°7′. This angle β also is selected in such a manner that the projection d onto the horizontal axis of the distance between the centres of two adjacent wires 31 should be an entire multiple of the elementary pitch p. In particular, when β=61°7′, the distance d is equal to 7p and is 0.3703 mm.

In this third working condition, and for this type of printing, the distance s between two successive dots along the horizontal direction of writing is equal to four elementary pitches p, and is 0.2116 mm. As this space has to be travelled through by carriage 21 in time T, the speed of travel of the carriage 21 is 211.6 mm/sec. At this speed, the head 20 can write about 83 characters per second, Also in this latter case the data transmitted to the central unit 60 are first memorised one line at a time on one of the RAM memories 66 or 67, and then despatched serially to the ROM 83 n, through circuit 81. In this case the central unit 60 sets the binary counter 77 in such a manner that at each FQ pulse a pulse FS enabling printing is generated.

The elementary pitch p=0.0529 mm corresponds to 1/480″ and has been selected considering that the characters are normally written with constant spacings of 10, 12 or 15 characters per inch, or with different spacing pitches, multiples of 1/60″. In accordance with this selection the spacing of a character with 1/10″ spacing is divided into 48 parts, and the spaces of the characters of 1/12″ and 1/15″ and proportional ones are subdivided respectively into 40 parts, 32 parts and entire multiples of 8 parts.

It will be clear from the present description that the slanting of the writing ends of the wires 31 relative to the direction of writing is selectively variable from a first position in which the wires 31 can write simultaneously at least two lines of writing, to a plurality of other positions in which the wires 31 can write on a single line symbols and characters with dot matrices with variable definition.

It is clear that in addition to those described so far, other types of writing, with other dot matrices, may be printed by the device according to the invention.

It is also obvious that it is possible to effect alterations or additions of parts to the printing device described so far, without departing from the scope of the present invention. For example, the writing wires may be in much greater numbers and the lines of characters written simultaneously may be more than two. Although the invention will be described mainly in terms of wire printers in which the printing elements are wires actuated for impact printing of the dots by electromagnets, it is not restricted to a particular type of printing element. For example, thermal dot matrix printers are known using resistive printing elements heated by current pulses. Also ink jet dot matrix printers are known wherein the printing occours by injection of particles of ink towards the recording medium.

What I claim is:

1. A dot printing device for printing characters and graphic symbols on a recording medium according to dot matrices which each have a predetermined standard height (h) said device comprising a print head having longitudinally movable printing wires, a plurality of electromagnets associated with said printing wires, an electronic circuit for the energization of said electromagnets and the actuation of the associated wires to impact said recording medium for printing thereon, and a guide member for guiding said printing wires adjacent to said recording medium and positioning them in an array, wherein the height (l) of said array of wires is at least twice said standard height (h), means for moving said print head parallel to said recording medium along a rectilinear path, means for varying the inclination of said guide member from a first angular position wherein said array of wires is substantially perpendicular to said rectilinear path to a second angular position wherein said single array is slanted with respect to said rectilinear path, and means associated with one or the other position of said guide member in order to control the actuation of said printing wires for simultaneously printing two lines of characters and graphic symbols with low definition dot matrices and high printing speed when said guide member is in said first angular position and for printing only one line of characters and graphic symbols with a high definition dot matrix having said standard height when said guide member is in said second angular position, said electronic circuit comprising a central unit connected to an input device and to at least two line memories, the data to be printed supplied by said input device being memorized in alternate lines on said two memories and taken from said central unit in parallel manner when said guide member is in said first angular position, and being memorized one line at a time on one of said memories and taken in serial manner by said central unit when said guide member is in said second angular position.

2. A dot printing device according to claim 1, wherein said varying means is operable to incline said guide member in a third angular position, and wherein said associated means control the actuation of said printing wires for printing a line of characters and graphic symbols according to a dot matrix of height greater than said standard height with a dot definition which is higher than said low definition and lower than said high definition.

3. A dot printing device according to claim 2, wherein said means for varying the inclination of said guide member comprises gear means connected to said print head and operable by an electric motor.

4. A dot printing device according to claim 2, wherein said associated means comprise sensing elements for sensing the angular position of said guide member.

5. A dot printing device according to claim 1, wherein the height of said array of wires is twice said standard height plus a predetermined length including other wires of the array, wherein said other wires are not actuatable in the first position of the guide member, whereby causing said two lines of characters to be spaced through said predetermined length and wherein said other wires of the array are actuatable in the second position of said guide member in order to obtain said high definition dot matrix.

* * * * *